US006556796B1

(12) United States Patent
Chavez et al.

(10) Patent No.: US 6,556,796 B1
(45) Date of Patent: Apr. 29, 2003

(54) DRUM-LOADING/UNLOADING APPARATUS FOR ELECTROSTATOGRAPHIC PRINTER/ COPIER

(75) Inventors: Jorge Luis Chavez, Rochester, NY (US); Adolf Phillip Greiner, Sinsheim (DE); Ralph Edward Williams, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/054,453

(22) Filed: Jan. 22, 2002

Related U.S. Application Data

(63) Continuation-in-part of application No. 09/877,777, filed on Jun. 8, 2001, now Pat. No. 6,484,002, which is a continuation-in-part of application No. 09/574,425, filed on May 19, 2000, now Pat. No. 6,263,177.

(51) Int. Cl.[7] ..... G03G 21/16
(52) U.S. Cl. ..... 399/110; 399/117
(58) Field of Search ..... 101/216, 218; 399/110, 116, 117, 159, 167

(56) References Cited

U.S. PATENT DOCUMENTS 6,259,873 B1 * 7/2001 Shifley et al. ..... 399/110
6,308,030 B1 * 10/2001 Taylor et al. ..... 399/121
6,427,059 B1 * 8/2002 Buch et al. ..... 399/110

* cited by examiner

*Primary Examiner*—Hoang Ngo

(57) ABSTRACT

Apparatus is provided for facilitating the loading of a hollow cylindrical drum, for example, an image-recording drum in an electrostatographic printer or the like, onto a rotatably driven drum axle having a free end extending outwardly in a cantilever manner from a support frame and having a longitudinally-extending axis of rotation. According to a preferred embodiment, such apparatus generally comprises a plurality of slide mechanisms disposed at equal distances from each other and from the intended axis of drum rotation. Each of the slide mechanisms comprises a pair of elongated slide members extending parallel to said axis of rotation, one of the slide members of each of each pair being rigidly supported by said drum axle, and the other slide members of each pair being slidably mounted on the rigidly supported slide members for movement parallel to the drum axis. The slidably mounted slide members are operable to collectively support the drum from within for axial movement between a drum-loading position axially spaced from the drum axle and a loaded position atop the drum axle.

9 Claims, 7 Drawing Sheets

DRUM-LOADING/UNLOADING APPARATUS FOR ELECTROSTATOGRAPHIC PRINTER/COPIER

CROSS-REFERENCE TO RELATED APPLICATIONS

Reference is made to the commonly assigned U.S. patent application Ser. No. 09/574,425, filed on May 19, 2000, and entitled "Document Printer/Copier with Decoupleable Drum-Support Member" (now U.S. Pat. No. 6,263,177, issued on Jul. 17, 2001), and U.S. application Ser. No. 09/877,777, filed on Jun. 8, 2001, now U.S. Pat. No. 6,484,002 a Continuation-in-Part thereof, the disclosures of which are incorporated herein by reference.

FIELD OF THE INVENTION

The present invention relates to improvements in apparatus for loading (and unloading) a hollow drum onto (and from) a cantilever-mounted axle adapted to support the drum for rotation. The apparatus of the invention is particularly useful for loading and unloading an image-recording or image-transfer drum in an electrostatographic printer/copier in which minimal clearance is provided between the drum surface and the various processing stations associated with the electrostatographic imaging process.

BACKGROUND OF THE INVENTION

Referring to FIGS. 1–3, the above-referenced U.S. application Ser. No. 09/574,425 discloses an electrostatographic document printer 10 that comprises a pair of confronting, cantilever-mounted drums 12 and 16. Drum 12 typically comprises a hollow metal cylinder having a photoconductive outer layer 14 and serves to record images, in a conventional manner, via the well-known electrostatographic process. Briefly, as drum 12 rotates counter-clockwise, layer 14 is uniformly charged at a primary charging station 20, image-wise exposed with actinic radiation at an exposure station 22 to produce a charge image on layer 14, and subjected to toner particles that selectively adhere to the charge image to render such image visible. Continued rotation of drum 12 results in the intermediate transfer of the previously formed toner image to a non-stick outer surface 18 of drum 16. Thereafter, the image-recording surface of drum 12 is cleansed at cleaning stations 25 and 26, readying the drum for subsequent image recording. Meanwhile, the toner image on drum 14 is transferred to an image-receiver sheet (not shown), and the drum surface 18 is cleaned at a cleaning station 28. As will be appreciated, all of the aforementioned processing stations are precisely positioned in close proximity to the outer surfaces of the drums 12 and 16, and great care must be taken in removing the drums for servicing lest the drum surfaces be damaged by the hardware of the processing stations.

In the printer described above, drums 12 and 16 are rotatably supported by a pair of axles A2 and A3, respectively, that extend outwardly, in a cantilever fashion, from the rear mech plate RP of the printer support frame. Referring to FIG. 2, a solenoid-operated drum-support mechanism 32 serves to provide support for the free ends of axles A2 and A3 during drum rotation. Such support mechanism is movably mounted on a pivot mount 50 for movement between an operable position in which it supports both drum axles A1 and A3, and a stand-by position (shown in FIG. 2) in which it is sufficiently spaced from the drums to enable axial movement of the drums for removal and servicing. In use, the image-recording drum 12 is supported at its opposite ends 12A and 12B by a pair of gudgeons 40 and 42 that are releasably press fit into the respective ends of the drum. The rear gudgeon 40 is rotatably mounted directly on axle A2, whereas the front gudgeon 42 is rotatably mounted on a stub axle assembly A1 that, in use, is releasably connected to the free end of axle A2. When so connected, beveled edges on each gudgeon cooperate with beveled edges at each drum end to center the drum on the longitudinal axis of axle A2. As disclosed in the aforementioned application, when axle assembly A1 is disconnected from axle A2, drum 12 will slide off its supporting gudgeons and will be free to move axially, through an opening in the printer's front mech plate FP for servicing.

As best shown in FIG. 3, careful axial movement of drum 12 from the printer frame is facilitated by a drum-loading/unloading structure 100 that is supported by axle A2 within the drum interior. The drum loading/unloading structure comprises a pair of discs 102, 103 and a plurality of interconnecting rods 104. Discs 102, 103 are provided with concentrically arranged central apertures 102A, 103A, each being adapted to receive and slide upon axle A2. Rods 104 are mutually parallel with each other and with the longitudinal axis of axle A2. The most radially outward surface of each rod extends slightly outside the perimeter of each of the supporting discs and lies on a circle having a diameter slightly less than the inside diameter of drum 12. The respective lengths of the rods, including their extensions 104A that extend beyond disc 103, are slightly less than the length of drum 12. Thus, upon removing gudgeon 42 from the end 12B of the drum 12, it will be appreciated that the drum will slide off the beveled edge of gudgeon 40 and thereby be collectively supported by several of the underlying rods 104 of the drum-loading/unloading structure. To remove the drum from axle A2, the operator grasps handles 106 mounted on disc 103 and exerts an axially outward force.

While the drum-loading/unloading apparatus described above is useful in reducing any damage to the drum surface as the drum is removed from the printer frame, it is problematic in certain respects. For example, it will be appreciated that axial movement of the drum will be supported by axle A2 only so long as the central aperture 103A of disc 103 maintains contact with the axle A2. Once contact is lost as the drum continues to move axially outward, it is up to the operator to assure that the drum axis remains substantially co-linear with the axis of axle A2; otherwise, the relatively delicate outer surface of the drum may physically contact the hardware of the various processing stations of the printer and cause damage. Ideally, the drum should be mechanically supported until the drum clears all potentially harmful surfaces as it moves axially from the printer frame. A further problem associated with the drum loading/unloading apparatus of the type described is that, being incapable of providing support for the drum at all times during of its axial movement, relatively slight defects in the drum surface cannot be addressed without totally removing the drum from the printer frame.

SUMMARY OF THE INVENTION

In view of the foregoing discussion, an object of the present invention is to provide an improved drum-loading/unloading apparatus of the type described, one that is substantially more robust than the prior art apparatus, and one that overcomes the aforementioned problems of the prior art apparatus.

According to the invention, an improved apparatus is provided for facilitating the loading and unloading of a hollow cylindrical drum, for example, an image-recording drum in an electrostatographic printer or the like, onto a drum axle having a free end extending outwardly in a cantilever manner from a support frame and having a longitudinally-extending axis about which the drum is adapted to rotate. According to a preferred embodiment, the apparatus of the invention comprises a plurality of telescoping slider mechanisms disposed at equal distances from each other and from the axis of the drum axle. Each of the slider mechanisms comprises a pair of elongated slide members extending substantially parallel to the drum axle. One of the slide members of each pair is rigidly supported by the drum axle, and the other slide member of each pair is slidably mounted on the rigidly supported slide member for movement parallel to the drum axle axis. The slidably mounted slide members of each pair cooperate to support the drum from within for axial movement between a drum-loading position axially spaced from the drum axle, and a loaded position atop the drum axle. Preferably, a total of three slider mechanisms are used to slidably support the drum, and each the slide mechanisms comprises a common drawer slider mechanism of the type commonly used to support a drawer in a cabinet for movement between a closed and open position. Preferably, a latching mechanism is provided to selectively latch the slidably mounted slide members in their respective drum-loading positions to facilitate loading of a drum onto the slide members.

The drum-loading/unloading apparatus of the invention is substantially more robust in construction than the aforementioned prior art structure, and it provides full support for the drum during axial movement of the drum between its operating position and a service position substantially spaced from the drum's operating position, such as outside the support frame of the drum-utilization device. Thus, the drum may be handled and worked on, e.g., for cleaning purposes, without physically removing the drum from the loading/unloading apparatus. Further, the loading aid is significantly less costly to assemble and install in the supporting instrument.

BRIEF DESCRIPTION OF THE DRAWINGS

The invention and its advantages will be better understood from the ensuing detailed description of preferred embodiments, reference being made to the accompanying drawings in which like reference characters denote like parts.

DETAILED DESCRIPTION OF THE INVENTION

Figure 1:
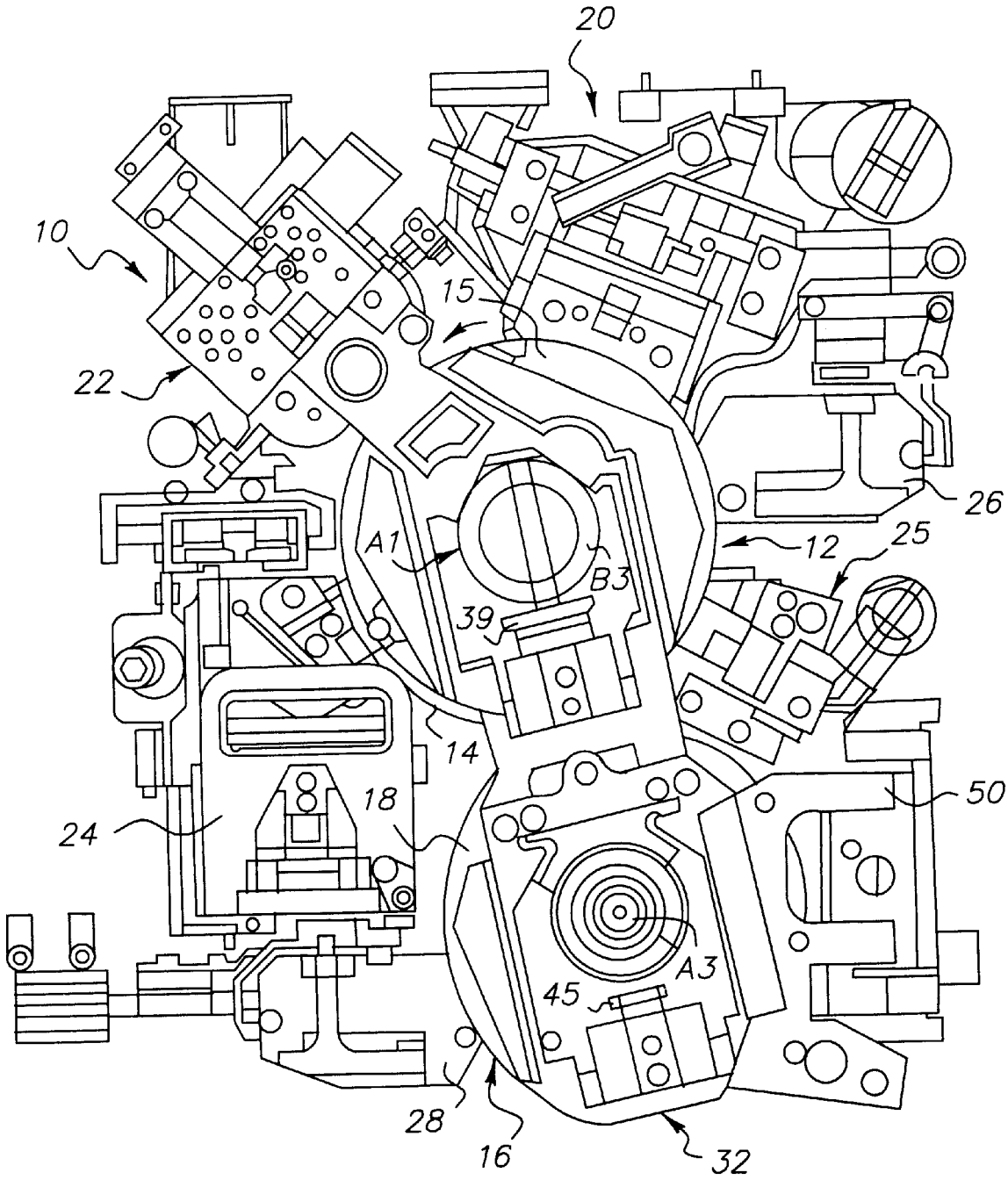
FIG. 1 is a side elevation illustration of an electrostatographic printer of the type in which the invention is particularly useful.
Figure 2:
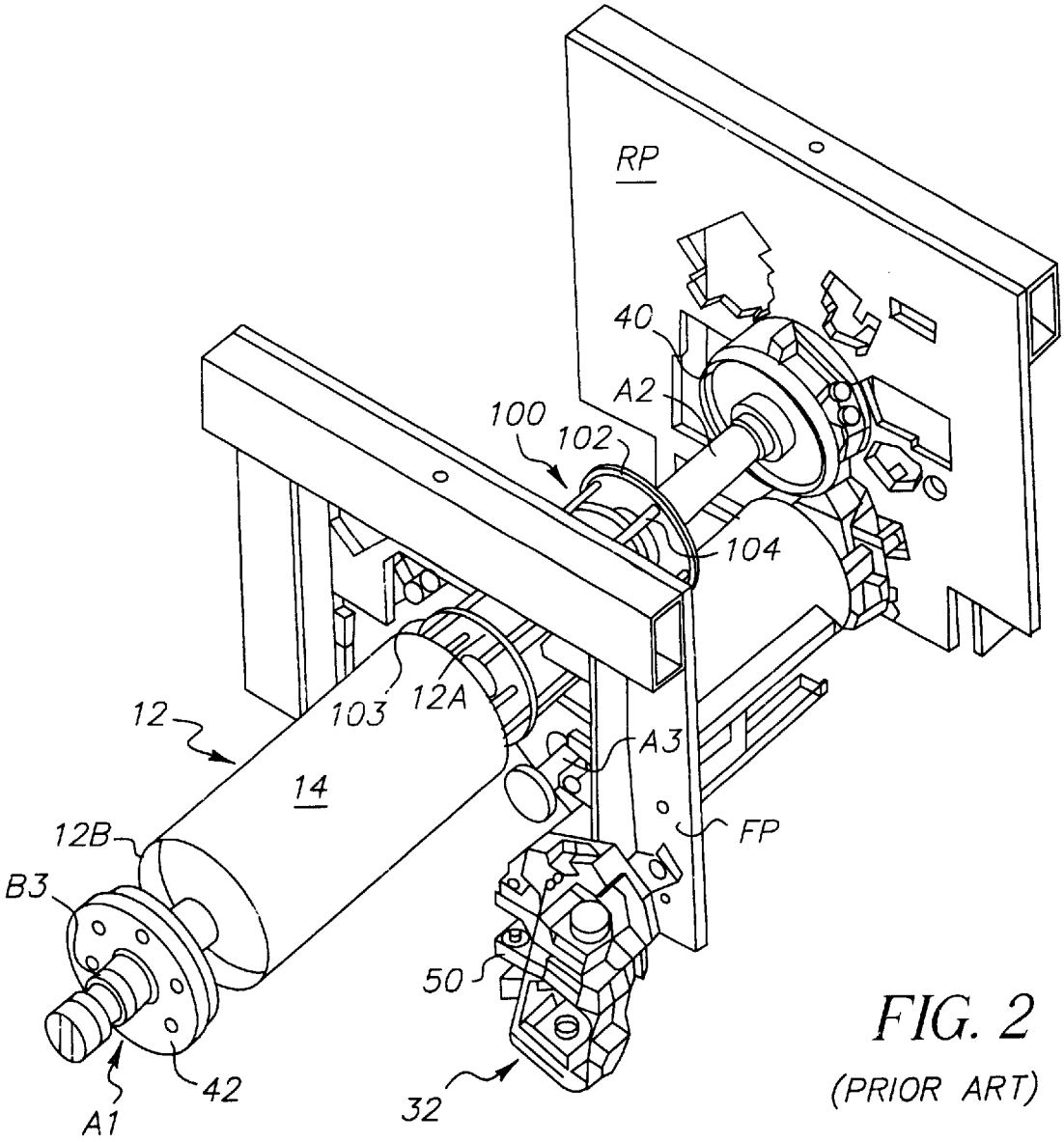
FIG. 2 (PRIOR ART)
FIG. 2 is an exploded view of a portion of the FIG. 1 apparatus.
Figure 3:
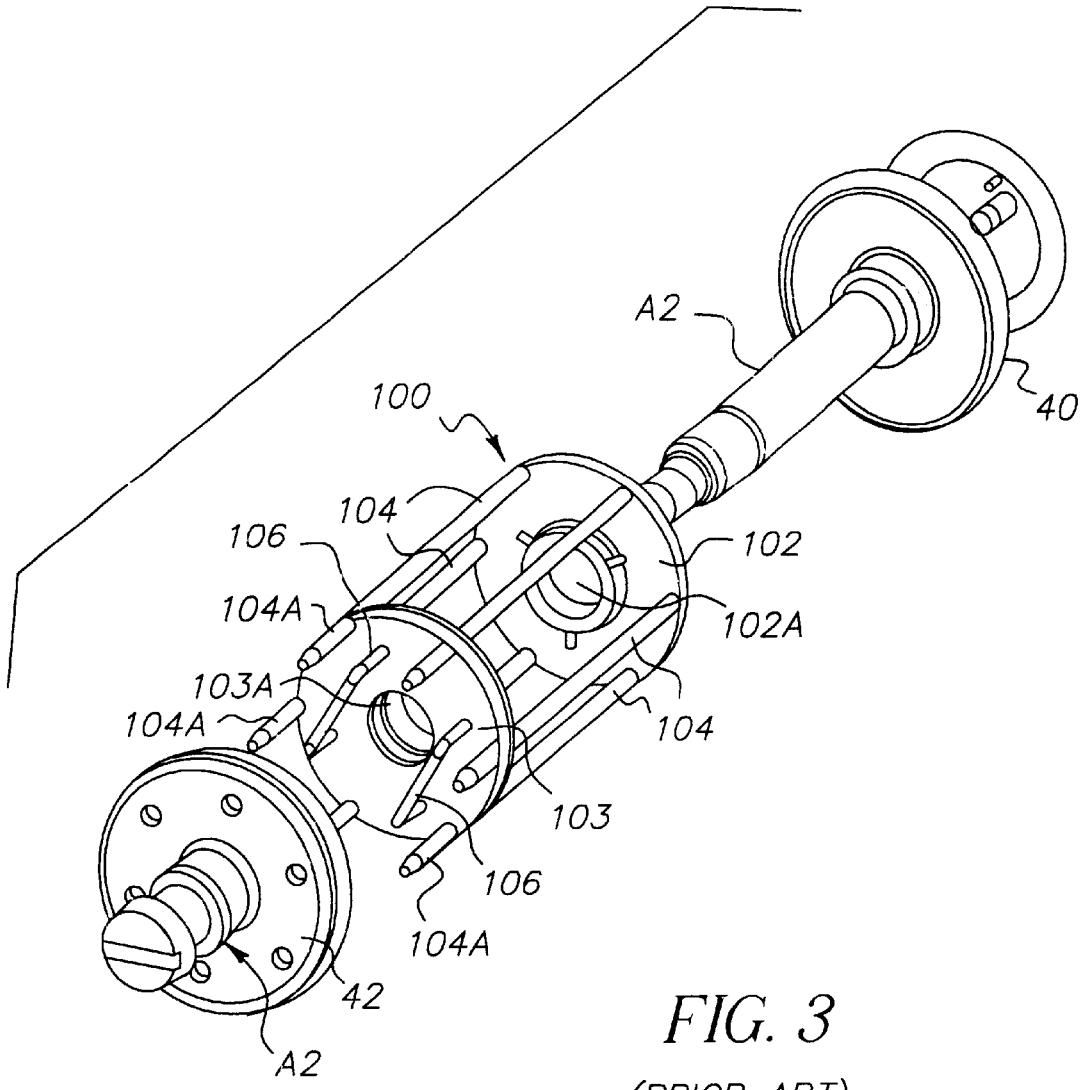
FIG. 3 (PRIOR ART)
FIG. 3 is an exploded perspective view of a drum-loading/unloading apparatus structured in accordance with the prior art and discussed above.
Figure 4:
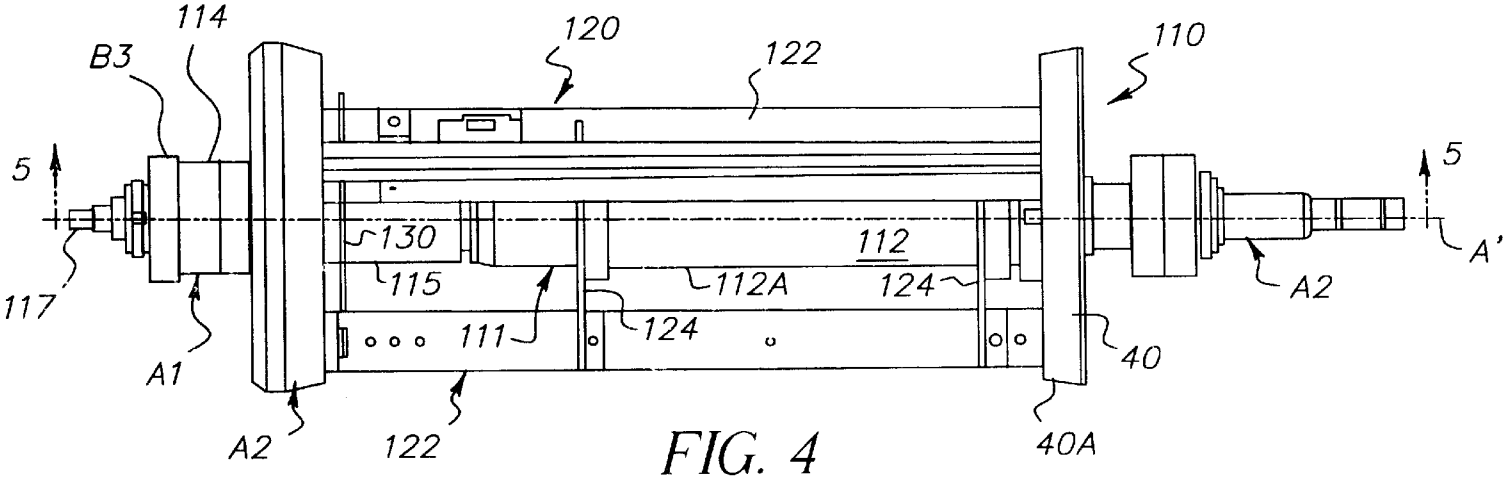
FIG. 4 is a side elevation of a drum-supporting assembly incorporating the present invention.
Figure 5:
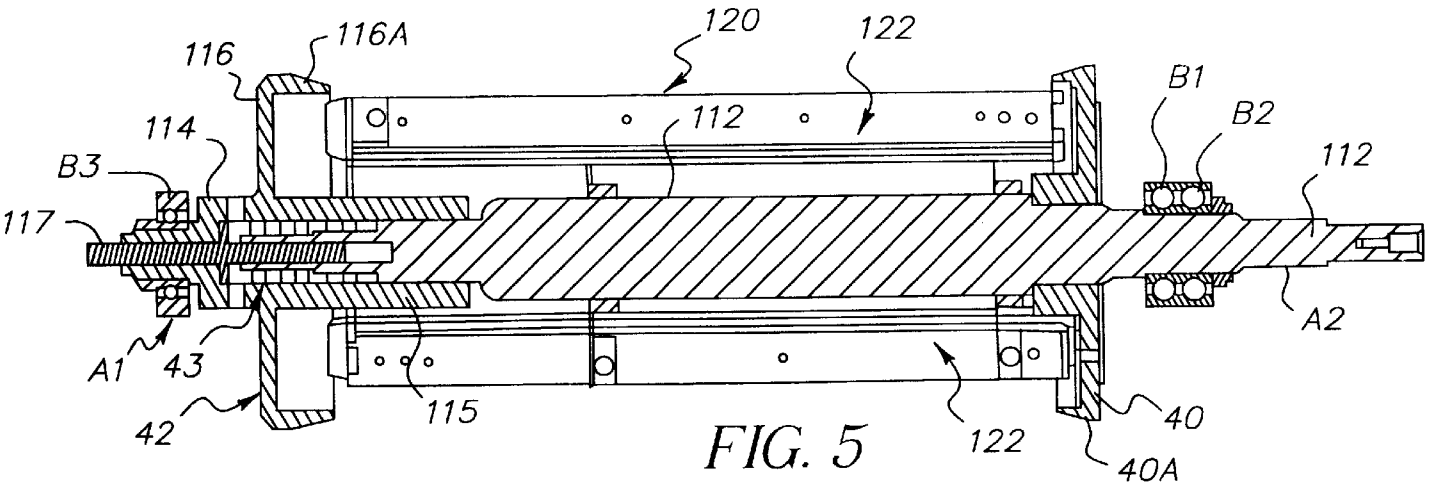
FIG. 5 is a cross sectional view of the FIG. 4 apparatus taken along the section line 5—5.

Referring now to FIGS. 4–9, a drum-supporting assembly 110 embodying the drum-loading/unloading apparatus of the present invention is shown to comprise a compound axle assembly 111 composed of a pair of axle sub-assemblies A1 and A2 that are releasably joined together at opposing ends. Axle sub assembly A2 comprises an axle member 112 that supports a pair of bearing assemblies B1 and B2, by which the axle member is supported for rotation, and a disk-shaped rear gudgeon 40 that serves, as discussed above, to support one end of a hollow drum D (shown in FIG. 9) so that the drum's longitudinal axis is substantially co-linear with the longitudinal axis A' of axle member A2. As shown, gudgeon 40 has a beveled inside rim edge 40A adapted to mate with a similarly shaped edge on a drum to be supported. In use, the outer races of bearings B1,B2 are rigidly clamped to a support plate (not shown) from which axle 112 extends in a cantilever fashion. The forward axle sub-assembly A1 comprises the front drum-supporting gudgeon 42 and an internal releasable coupling assembly 43 that enables the axle subs-assemblies A1 and A2 to be either rigidly connected together or separated. The front gudgeon 42 is a one-piece structure comprising a front axle portion 114, a sleeve portion 115 having a central bore adapted to receive the forward portion of axle member 112, and a flange portion 116 having a beveled rim 116A adapted to engage, support and center with respect to axis A' one end of a drum D. Activation of the coupling 43 is achieved by rotation of a threaded rod 117 that engages a threaded bore formed in the most forward end of axle member 112. Axle portion 114 of gudgeon 42 supports a bearing assembly B3 by which the axle member is rotatably supported on a movably-mounted front drum support (shown in FIG. 2 as member 32). As described in the above-referenced U.S. application Ser. No. 09/574,475, such movably-mounted front drum support is, in use, releasably engaged with the outer race of the bearing assembly B3 to provide support for the drum as it rotates within the bearing assembly. Upon de-coupling the front drum support 32 from the bearing assembly, the front drum support can be moved to a location sufficiently remote from the drum to enable the front axle assembly A1 to be de-coupled and removed from the rear axle assembly A2, thereby allowing the drum to be moved axially forward and, eventually, be removed from the rear axle assembly A2 for servicing and/or replacement.

Now in accordance with the present invention, the compound axle assembly 111 supports a drum-loading/unloading apparatus 120 that greatly facilitates the loading and unloading of a drum onto the axle assembly. Apparatus 120 is rigidly connected to, and is thereby supported by, axle member 112, and, preferably, such apparatus extends fully between the gudgeons 40 and 42 when a drum is supported by such gudgeons. Apparatus 120 comprises a plurality (preferably three) of elongated slide mechanisms 122, each extending parallel to the axle axis A' and being equally spaced from each other, as well as from the axle axis. The slide mechanisms 122 are supported by a pair of spider-shaped brackets 124, each bracket having a central circular opening 124A adapted to slide onto the major cylindrical portion 112A of axle member 112, and be fixed thereto (to prevent axial movement) by a set screw 126 or the like, shown in FIG. 7. Each of the spider brackets 124 has a plurality of outwardly-extending legs 128, equal in number to the number of slide mechanisms 122, and each leg is rigidly connected to a non-moving portion of the slide mechanism, as explained below. A third spider bracket 130 having a central circular opening 130A and a plurality of outwardly-extending legs 132 is also connected to the slide mechanisms and provides forward support. Unlike brackets 124, however, bracket 130 is slidably supported by the sleeve portion 115 of gudgeon 42 so that the latter may be de-coupled from axle assembly A2 without disturbing the drum-loading/unloading apparatus.

Figure 8:
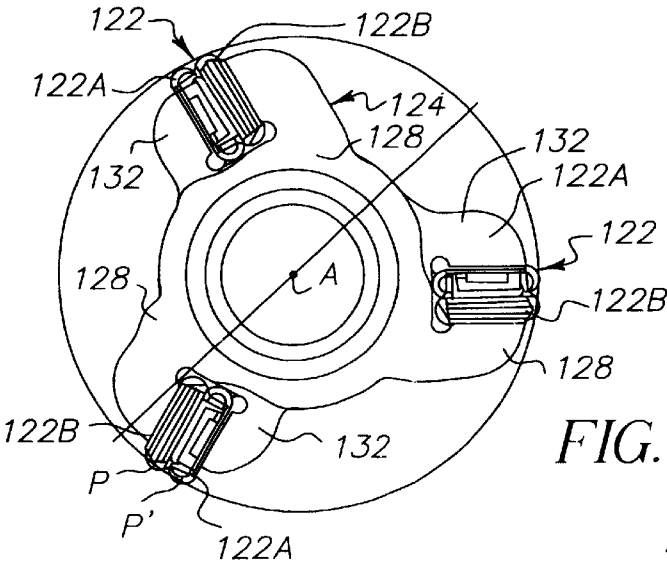
FIG. 8 is an end view of the FIG. 7 apparatus.
Figure 7:
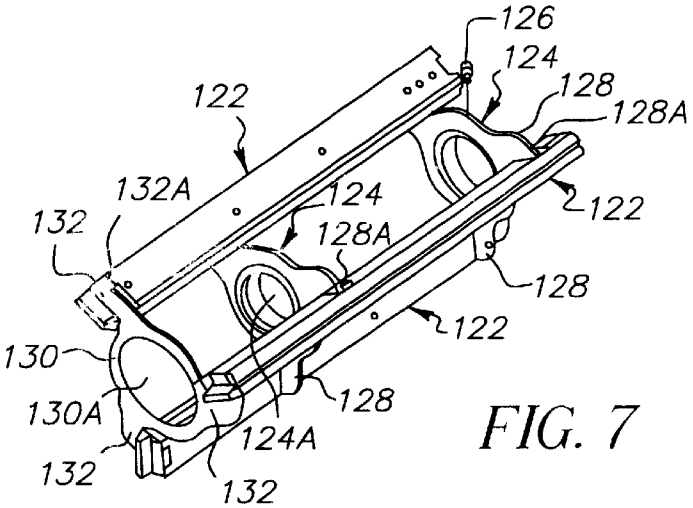
FIG. 7 is a perspective view of the drum loading/unloading apparatus of the invention with the drum-supporting sliders in a retracted state.
Figure 6:
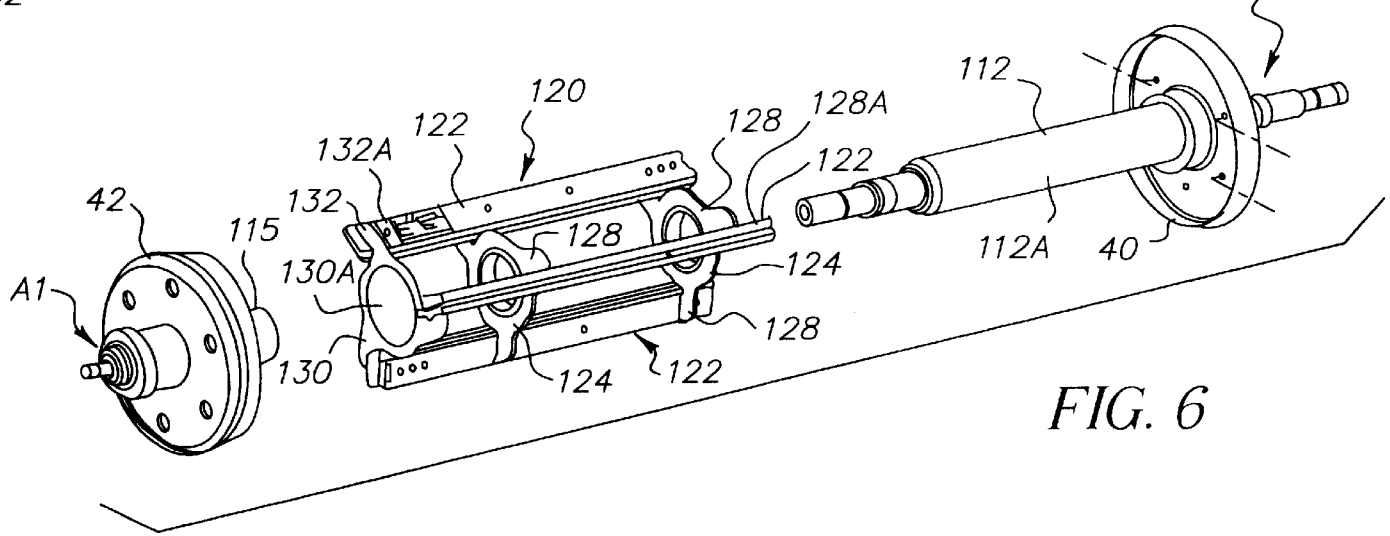
FIG. 6 is an exploded view illustrating the FIG. 4 drum-supporting assembly.
Figure 9:
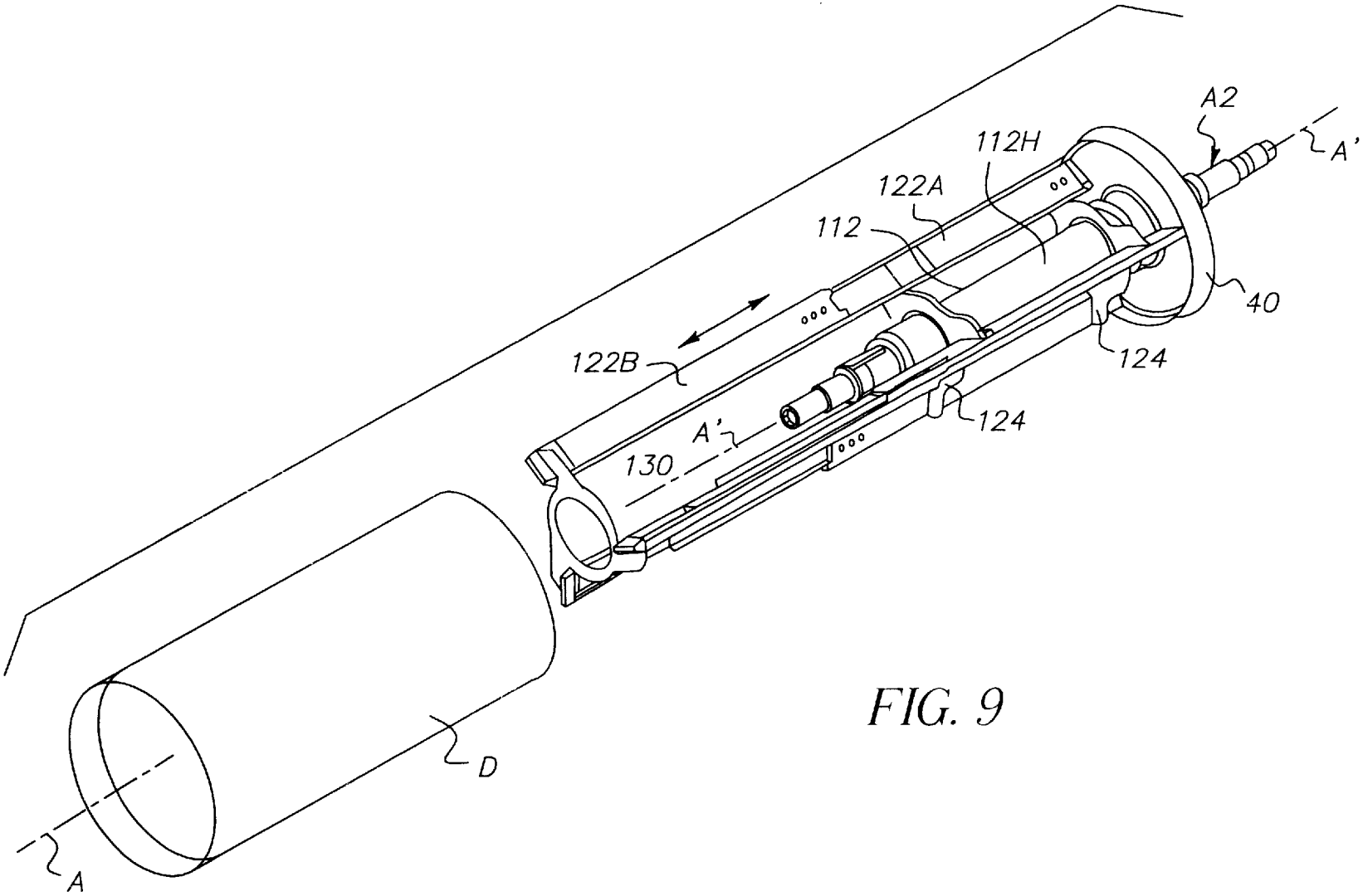
FIG. 9 illustrates the FIG. 7 apparatus in its extended position, ready to receive a drum for loading.

Referring to FIGS. 7–9 which best illustrate the details of the apparatus of the invention, each slide mechanism 122 preferably comprises a conventional "drawer slide" mechanism of the type commonly used to support a drawer as it moves between open and closed positions in a cabinet or the like. Such a mechanism comprises an elongated channel-defining member 122A and an elongated slider member 122B that is captured by and is free only to slide within the channel defined by member 122A. The channel-defining member 122A of each slide mechanism is rigidly connected to one of the legs 128 of the spider brackets 124 by a flange 128A extending at a right angle from the end portion of such legs. Thus, in the embodiment shown, each slide mechanism 122 is rigidly supported at two locations along its length atop, and at a fixed location on, axle portion 112A by virtue of the rigid connection of at least one of the spider brackets 124 to the axle via set screw(s) 126 that passes through a circular flange on at least one of the brackets and engages the underlying axle. One end of each of the slider members 122B is rigidly connected to the third spider bracket 130 via a suitable flange and screw connection 132A at the respective ends of the spider legs 132. As noted above, the circular central opening 130A of spider bracket 130 is adapted to receive the sleeve portion 115 of the forward gudgeon 42 when the latter is positioned on the drive shaft 112. Thus, the parallel and physical relationship of the slider members relative to their respective support channels is maintained throughout the linear movement as the slider members from their "home" or retracted positions (shown in FIGS. 4–7) and their fully extended positions, as shown in FIG. 9.

As best shown in FIG. 8, each of the slider members 122B has a portion P that extends radially outward relative to axle axis A by a distance slightly greater than the most radially outward portion P' of the channel-defining members 122A. Each of the portions P lie on a circle having a diameter slightly smaller than the inside diameter of drum D. Thus, as the axle assembly A1 is de-coupled from axle assembly A2 and the front gudgeon 42 is removed from its engagement with the front edge of the drum, the drum will slide (incrementally) forward, off the beveled edge 40A of rear gudgeon 40; having done so, the drum will be totally supported by at least two of the slider members 122B. To remove the drum from its position atop the axle assembly A2, the operator need only lightly grasp the forward edge of the drum and pull it forward. As a result, the drum will slide axially forward, being supported all the way by the underlying slider members that are traveling within their associated channel-defining members 122A. Thus, in contrast with the afore-described drum-loading apparatus of the prior art, there is no need for the operator to physically support the drum during a major portion of its axial travel, and any potential damage to the drum surface is minimized.

Figure 10:
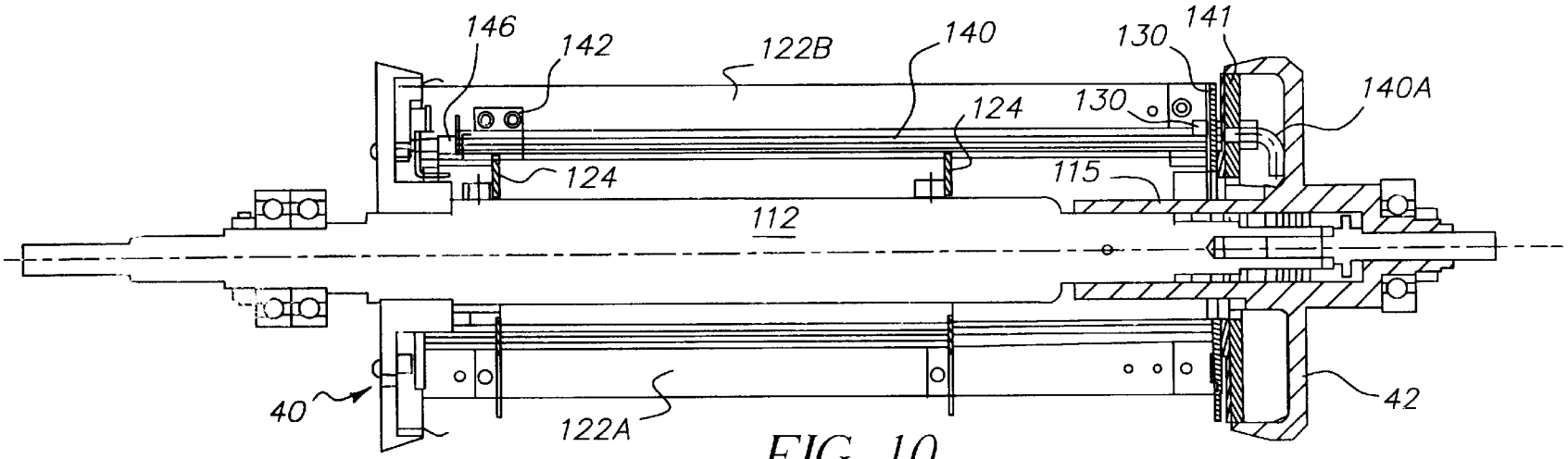
FIG. 10 is a cross-sectional view of a drum assembly having a latching mechanism for selectively latching the slidably mounted slide members of the drum loading/unloading apparatus in a drum-loading position.
Figure 12:
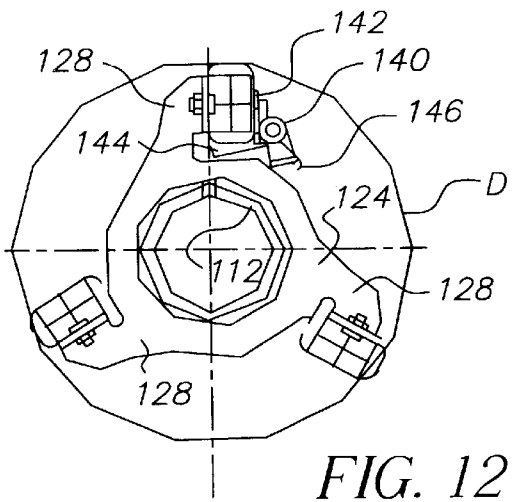
FIGS. 11 and 12 are end views of the drum-loading apparatus showing the latching mechanism in latching and unlatched positions, respectively.
Figure 11:
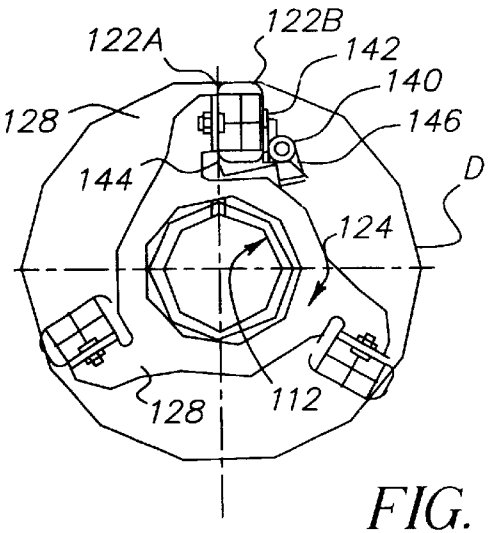

To facilitate the loading or re-loading of a drum onto the loading/unloading apparatus 120 while the slider members 122B are in their respective extended positions (shown in FIG. 9), it is preferred that a latching mechanism be provided to selectively prevent axial movement of the slider members (toward their home positions) while the drum is being manually positioned on the ends of the slider members and urged axially towards a position in which the drum is fully supported by the slider members. According to a preferred embodiment, such latching mechanism (shown in FIG. 10) comprises an elongated, latch-actuating rod 140 that is supported in a position generally parallel to axis A' by one of the slider members 122B and by the spider bracket 130. More specifically, rod 140 is supported for rotation about its longitudinal axis by a mounting bracket 142 attached near the rearward end of one of the fixed slider members 122B, and by a hole 130B formed in an arm of the movable spider bracket 130. Optionally, the rod 140 may be further supported by a disk 141 positioned at the front end of the drum, the outer circular edge such disk serving to facilitate the initial loading of a drum onto the front edges of the extended slider members 122B. The rotational position of rod 140 within suitable apertures formed in the support brackets is controlled by an integral handle 140A extending perpendicular to the rod axis. An latching member 144 extends radially outward from the distal end (opposite the handle end) of the rod, and a torsion spring 146 wrapped about rod 140 serves to bias the rod for rotation in a direction such that the latching member is normally positioned behind the innermost edge (closest to rear gudgeon 40) of the stationary channel-defining member 122A associated with the slider member 122B that supports the latch-actuating rod.

Thus, when the slider member 122A that supports rod 140 is in its home position, i.e., totally within its associated channel-defining member 122B, the drum-loading/unloading apparatus is latched in place. Upon manually rotating the rod via handle 140A in a counter-clockwise direction, as viewed from the front end of the drum assembly, the latch member 144 will move against the opposing force of the torsion spring until clears the edge of the fixed slider member 122A. In this position, the movable slider members 122B of the drum-loading/unloading aid are free to be withdrawn to their fully extended positions. As the movable slider members 122B are withdrawn, latch 144 rides on the longitudinal edge surface of one of the fixed slider members 122A until the movable members 122B reach their fully extended positions, whereupon the latch member moves off such edge, under the force of the torsion spring, and falls to a latching position behind the outermost end edge of the fixed slider member. During loading a drum onto the extended slider members, the movable slider members will, due to the latching mechanism, remain stationary until the drum is fully loaded onto the loading/unloading aid. To reposition the drum onto the rear axle assembly A2, the operator again rotates the rod 140 counter-clockwise, thereby moving the latching member away from its latching position, and then slides the drum and its underlying loading/unloading aid toward the home position. By virtue of the latching mechanism, there is no need to manually hold the slide members in their extended position while attempting to load the drum onto the loading/unloading aid.

The invention has been described with reference to a particularly preferred embodiment. It will be apparent, however, that certain modifications can be made without departing from the spirit of the invention, and such modifications are intended to be protected by the following claims.

PARTS LIST

| | |
|---|---|
| 10 | printer |
| 12 | image-recording drum |
| 12A and 12B | beveled drum edges |
| 14 | photoconductive surface |
| 16 | image-transfer drum |
| 18 | non-stick sleeve |
| 20 | corona charging station |
| 22 | exposure station |
| 24 | development station |
| 25 | cleaning station |
| 26 | cleaning station |
| 28 | image-transfer drum cleaner |
| 32 | movable drum support |
| 40 | rear drum gudgeon |
| 42 | front drum gudgeon |
| 50 | pivot mount |
| RP | rear mech plate |
| FP | front mech plate |
| A1, A2, A3 | axle assemblies |
| A | drum axis |
| A' | axle axis |
| 100 | drum-loading aid (prior art) |
| 102,103 | disks |
| 104 | rods |
| 104A | rod extensions |
| 106 | handles |
| 110 | drum supporting apparatus |
| 111 | axle member of A2 |
| 112 | major portion of axle member 111 |
| 112A | surface of 112 |
| 114 | axle member of A1 |
| 115 | collar portion of A1 |
| 122 | slide mechanisms |
| 122A | channel-defining slide member |
| 122B | slider member |
| P | outermost portion of 122B |
| P' | outermost portion of 122A |
| 124 | spider brackets |
| 124A | central opening in brackets 124 |
| 126 | set screw |
| 128 | bracket legs |
| 128A | flange on bracket legs |
| 130 | third bracket member |
| 130A | central opening in bracket 130 |
| 130B | hole in bracket leg |
| 132 | leg portions of bracket 130 |
| 140 | latch rod |
| 141 | disk |
| 140A | handle |
| 142 | bracket |
| 144 | latching member |
| 146 | torsion spring |
| D | drum |

What is claimed is:

1. Apparatus for facilitating the loading and unloading of a hollow cylindrical drum on a drum axle, said drum axle having a free end extending outwardly in a cantilever manner from a support frame and having a longitudinally-extending axis, said apparatus comprising:

a plurality of slide mechanisms, each of said slide mechanisms comprising a pair of elongated slide members extending parallel to each other and being slidably connected to enable said slide members to move in parallel directions; and at least one bracket member operating to (i) rigidly interconnect one of said slide members of each of said pairs to said drum axle, (ii) establish a parallel relationship between each of said slide mechanisms and said axle axis; (iii) equally space said slide mechanisms about said axis; and (iv) support the other of said slide members in a position to support said drum from the inside.

2. The apparatus as defined by claim 1 wherein said bracket member has a central opening for receiving said drum axle and a central collar arranged about said opening for securing said bracket member to said axle.

3. The apparatus as defined by claim 1 wherein at least two bracket members axially spaced on said axle operate to provide the functions (i)–(iv).

4. The apparatus as defined by claim 1 wherein a second bracket interconnects said other slide members and establishes a desired relationship therebetween, said second bracket member being free to move with said other slide members.

5. The apparatus as defined by claim 1 wherein said other slide members have a length substantially equal to or greater than the length of said drum.

6. Apparatus for facilitating the loading and unloading of a hollow cylindrical drum on a drum axle, said drum axle having a free end extending outwardly in a cantilever manner from a support frame and having a longitudinally-extending axis, said apparatus comprising:

a plurality of telescoping slider mechanisms disposed at equal distances from each other and from the axis of the drum axle, each of said slider mechanisms comprising a pair of elongated slide members extending substantially parallel to the drum axle, one of said slide members of each pair being rigidly supported by the drum axle, and the other slide member of each pair being slidably mounted on said rigidly supported slide member for movement parallel to the drum axle axis, said slidably mounted slide members of each pair cooperating to support the drum from within for axial movement between a drum-loading position axially spaced from the drum axle, and a drum-loaded position atop the drum axle.

7. The apparatus as defined by claim 6 further comprising a bracket member for maintaining the parallel relationship between the other of said slide members as the drum slides between said drum-loaded position to said drum-loading position.

8. The apparatus as defined by claim 7 further comprising a latch mechanism for selectively latching each of said other slide members in a predetermined position relative to its associated slide member.

9. The apparatus as defined by claim 8 wherein said latching mechanism comprises a rod mounted on one of said slidably-mounted slide members, said rod extending generally parallel to said axis and being mounted for rotation about its longitudinal axis, said rod having a latching member operatively connected thereto that is movable between latching and unlatching positions as said rod rotates.

* * * * *

UNITED STATES PATENT AND TRADEMARK OFFICE

CERTIFICATE OF CORRECTION

PATENT NO. : 6,556,796 B1 
DATED : April 29, 2003
INVENTOR(S) : Jorge L. Chavez et al.

It is certified that error appears in the above-identified patent and that said Letters Patent is hereby corrected as shown below:

Title page,
Item [63], Related U.S. Application Data, delete "Continuation-in-part of application No. 09/877,777, filed on Jun. 8, 2001, now Pat. No. 6,484,002, which is a continuation-in-part of application No. 09/574,425, filed on May 19, 2000, now Pat. No. 6,263,177".

Signed and Sealed this

Twenty-second Day of March, 2005

JON W. DUDAS
*Director of the United States Patent and Trademark Office*